US005746630A

United States Patent [19]

Ford et al.

[11] Patent Number: 5,746,630

[45] Date of Patent: May 5, 1998

[54] COMBINATION WET MARINE EXHAUST MUFFLER AND WATER SEPARATOR

[75] Inventors: John R. Ford, Xenia, Ohio; Sam V. Shelton, Atlanta, Ga.

[73] Assignee: Centek Industries, Inc., Thomasville, Ga.

[21] Appl. No.: 703,346

[22] Filed: Aug. 26, 1996

Related U.S. Application Data

[60] Provisional application No. 60/003,073 Aug. 31, 1995.

[51] Int. Cl.[6] ..... B63H 21/32

[52] U.S. Cl. ..... 440/89; 181/260

[58] Field of Search ..... 440/89; 60/310, 60/311, 274; 181/259, 260, 261, 235; 55/DIG. 30, 228, 229, 257.3, 257.4, 459.1, 337

[56] References Cited

U.S. PATENT DOCUMENTS

| | | | |
|---|---|---|---|
| 1,938,849 | 12/1933 | Maxim et al. | 440/89 |
| 2,487,176 | 11/1949 | Pitt et al. | 55/DIG. 30 |
| 2,511,713 | 6/1950 | Hoyle et al. | 183/21 |
| 2,763,982 | 9/1956 | Dega | 60/30 |
| 3,296,997 | 1/1967 | Hoiby et al. | 115/0.5 |
| 3,495,385 | 2/1970 | Glass | 55/237 |
| 3,630,030 | 12/1971 | Wagner | 181/261 |
| 3,759,041 | 9/1973 | North et al. | 60/310 |
| 4,019,456 | 4/1977 | Harbert | 115/73 |
| 4,344,538 | 8/1982 | Fujisawa et al. | 55/459.1 |
| 4,559,068 | 12/1985 | Lagerstedt et al. | 55/459.1 |
| 4,713,029 | 12/1987 | Ford | 440/89 |
| 5,022,877 | 6/1991 | Harbert | 440/89 |
| 5,196,655 | 3/1993 | Woods | 181/235 |
| 5,284,451 | 2/1994 | Chiu | 440/89 |

OTHER PUBLICATIONS

The Hydrocyclone, by D. Bradley, Pergamon Press, First edition 1965, pp. 195 and 196.

*Primary Examiner*—Ed L. Swinehart
*Attorney, Agent, or Firm*—Biebel & French

[57] ABSTRACT

A combined wet marine exhaust muffler and water separator comprises a housing having a tangential inlet for inducing the exhaust flow to rotate about a lengthwise axis of the housing, a first outlet positioned along the axis for conducting dried exhaust gas from the housing, and a second outlet positioned near a bottom end of the housing and spaced from the tangential inlet and the first outlet for draining water from the housing.

2 Claims, 4 Drawing Sheets

COMBINATION WET MARINE EXHAUST MUFFLER AND WATER SEPARATOR

CROSS-REFERENCES TO RELATED APPLICATIONS

This application claims the benefit of U.S. Provisional application Ser. No. 60/003,073, filed Aug. 31, 1995.

BACKGROUND OF THE INVENTION

1. Field of the Invention

The present invention pertains to exhaust mufflers for watercraft, and more particularly to improved combined wet exhaust mufflers and water separators for motorized marine craft.

2. Description of the Related Art

Internal combustion engines utilized in watercraft typically use the water supporting the craft for engine cooling purposes. The water is drawn into the craft and circulated through an engine cooling jacket or engine coolant heat exchanger. The water is then commonly injected into the exhaust system to cool the combustion gases so that they might be safely discharged through the hull of the craft without presenting a fire hazard. Accordingly, a marine exhaust muffler must handle not only exhaust gases, but also the waste cooling fluid or water which is injected into the exhaust system.

In addition to safely handling exhaust gases and waste coolant water, a marine muffler should muffle or attenuate the exhaust noise generated by operation of the marine engine. Muffling of exhaust noise from marine engines has been handled in a number of ways. For example, the exhaust may be discharged below the water level. In outboard engines and inboard/outboard installations the exhaust may be routed through the drive unit so that the exhaust gas and waste cooling water are discharged through or adjacent the propeller driving the craft. One water separator for use in outboard drive units with exhaust routed through the propeller under the water line is disclosed in North et al., U.S. Pat. No. 3,759,041.

Marine mufflers are commonly placed along the exhaust conduit running between the engine and the exhaust discharge. One such example is shown in Harbert, U.S. Pat. No. 5,022,877.

Often, marine muffler designs are closely akin to the mufflers used on automobiles, but constructed of materials such as fiberglass which can better tolerate the marine environment. While such mufflers are popular in the boating industry, many do not provide good attenuation of the noise generated by marine engines.

Furthermore, such mufflers often do not provide any or adequate water separation. The engine and muffler are often mounted amidship and located as far as 30 ft. to 40 ft. from the discharge. At these lengths it is difficult to maintain an overall downward grade necessary to drain the waste coolant water entrained in the exhaust flow. In practice, the exhaust conduit leading from the muffler to the discharge may curl up-and-down as it crosses various sections of the boat, creating traps where water may accumulate and constrict the exhaust flow.

The injection of water to cool exhaust gases is not limited to a marine environment. Techniques for injecting and separating water from combustion products are disclosed in Hole et al., U.S. Pat. No. 2,511,713, Dega, U.S. Pat. No. 2,763,982, and Glass, U.S. Pat. No. 3,495,385. It does not appear that any of the designs have been applied in a marine environment, however.

Despite the efforts made by the prior art, there remains a need for a marine wet muffler capable of both attenuating exhaust noise and efficiently removing waste coolant water from the exhaust flow.

SUMMARY OF THE INVENTION

This need is addressed by means of the muffler/water separator apparatus of the present invention that operates via centrifugal separation principles. The apparatus comprises a generally cylindrical housing having an inlet which induces an exhaust flow to rotate about the longitudinal axis of the housing, a first outlet positioned along the axis for conducting dried exhaust gas from the housing, and a second outlet positioned near a bottom end of the housing and spaced from the inlet and the first outlet for draining water from the housing. Several different configurations of the inlet are proposed for generating rotation of the exhaust flow about the longitudinal housing axis. In one embodiment, a tangential inlet includes a baffle for deflecting the exhaust flow along an inner wall of the housing. Alternatively, the inlet is provided with a vane structure for imparting rotational movement of the exhaust flow.

In the preferred apparatus, the tangential inlet includes a port opening into an interior of the housing and an inlet baffle near the port for deflecting the exhaust flow along the inner wall of the housing. In addition, the housing includes a transverse or calming baffle positioned in an interior of the housing such that the transverse baffle is positioned transverse to the longitudinal axis of the housing.

The preferred apparatus also includes a gas exhaust pipe concentric with the housing axis. One end of the gas exhaust pipe has a mouth positioned in the interior of the housing and the other end of the gas exhaust pipe communicates with the first outlet. The transverse baffle divides the interior of the housing into two chambers such that the tangential inlet and the mouth of the gas exhaust pipe are both in a first of the two chambers. According to one alternative embodiment, the first and second outlets are in a second of the two chambers and the gas exhaust pipe passes through the transverse baffle.

According to the preferred embodiment, the first outlet is positioned in the first of the two chambers and the second outlet is positioned in a second of the two chambers. As the exhaust flow rotates about the longitudinal housing axis, centrifugal force causes the relatively heavy droplets of water to move outwardly towards the inner housing wall. The water droplets pass through apertures in the transverse baffle leading from the first chamber to the second chamber and then drain through the second outlet near the bottom end of the housing. Meanwhile, the swirling exhaust gas is captured near the housing axis and is conducted through the gas exhaust pipe to the first outlet.

An alternative embodiment of the present invention provides that both the inlet and the gas exhaust pipe are coaxially disposed relative to the longitudinal housing axis. The exhaust flow enters and the dried exhaust gas exists the housing in a single axial direction, thereby permitting the advantageous placement of the muffler/water separator horizontally in a marine wet exhaust system. In this embodiment, the inlet includes a vane structure having a series of blades radially oriented about the longitudinal housing axis at a angle thereto for inducing the rotation of the exhaust flow. In addition, the housing includes a calming shield positioned adjacent to the blades and coaxially disposed relative to the longitudinal axis of the housing. The gas exhaust pipe includes a first end positioned within the interior of the housing and a second end in communication with the first outlet. The second outlet communicates with a conduit having a first end positioned within the housing and spaced below the gas exhaust pipe. The calming shield directs the rotating exhaust flow away from the gas exhaust pipe while centrifugal force causes the droplets of water within the exhaust flow to move outwardly towards the inner housing wall. The water droplets collect on the housing wall and drain through the second outlet near the bottom of the housing. Meanwhile, the dried exhaust gas passes through the gas exhaust pipe and out of the housing by way of the first outlet.

The muffler/water separator of the present invention is preferably included in a marine wet exhaust system for eliminating water from the exhaust gases of a marine engine. The system also comprises a first exhaust conduit for receiving exhaust gases from the marine engine and conducting the exhaust flow to the inlet of the housing, a water injector for injecting droplets of water into the first exhaust conduit, a second exhaust conduit for receiving exhaust gases from the first outlet of the housing and exhausting the exhaust gases, and a water drain for receiving water from the second outlet of the housing and releasing the water, preferably below the water line. Since virtually all of the waste coolant water is removed from the exhaust flow in the housing, the second exhaust conduit need not have a downward grade. Consequently, the exhaust gas may be expelled above the water level, even if the engine and muffler themselves are located below the water line. While the muffler/water separator attenuates exhaust noise itself, one alternative form of the wet marine exhaust system includes an additional muffler positioned across the second exhaust conduit downstream of the combined muffler/water separator to provide additional sound attenuation. The design of this additional muffler can be more like those used in automotive exhausts since the exhaust conduit here is absent of the cooling water. Therefore the amount of exhaust noise attenuation at the expense of additional back pressure added to the system is considerably less than in the prior art.

The invention will be further described in conjunction with the appended drawings and following detailed description.

DETAILED DESCRIPTION OF THE PREFERRED EMBODIMENT

Figure 1:
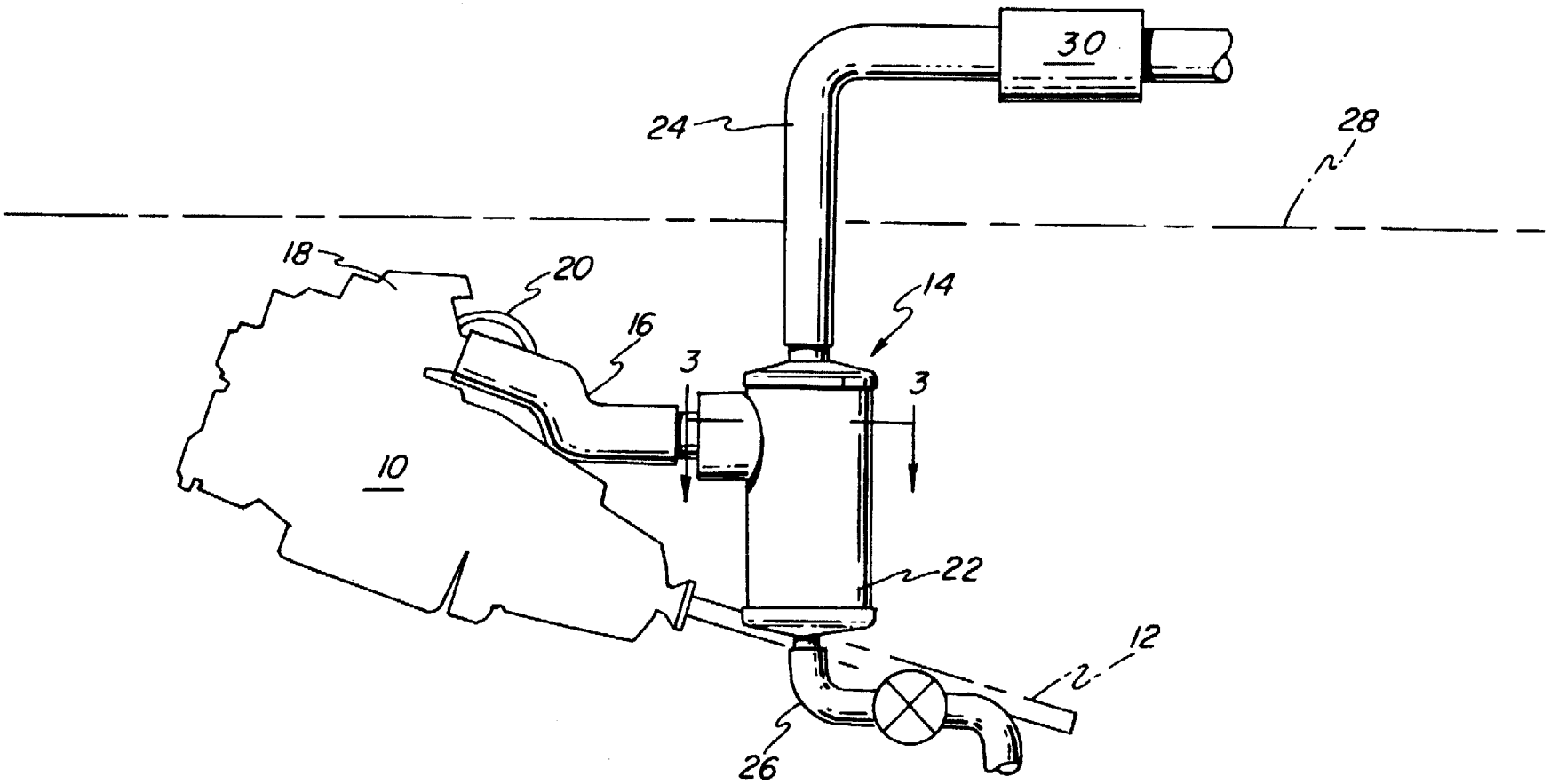
FIG. 1 is a schematic view of a marine wet exhaust system incorporating the combined marine wet muffler and water separator of the invention.
Figure 2:
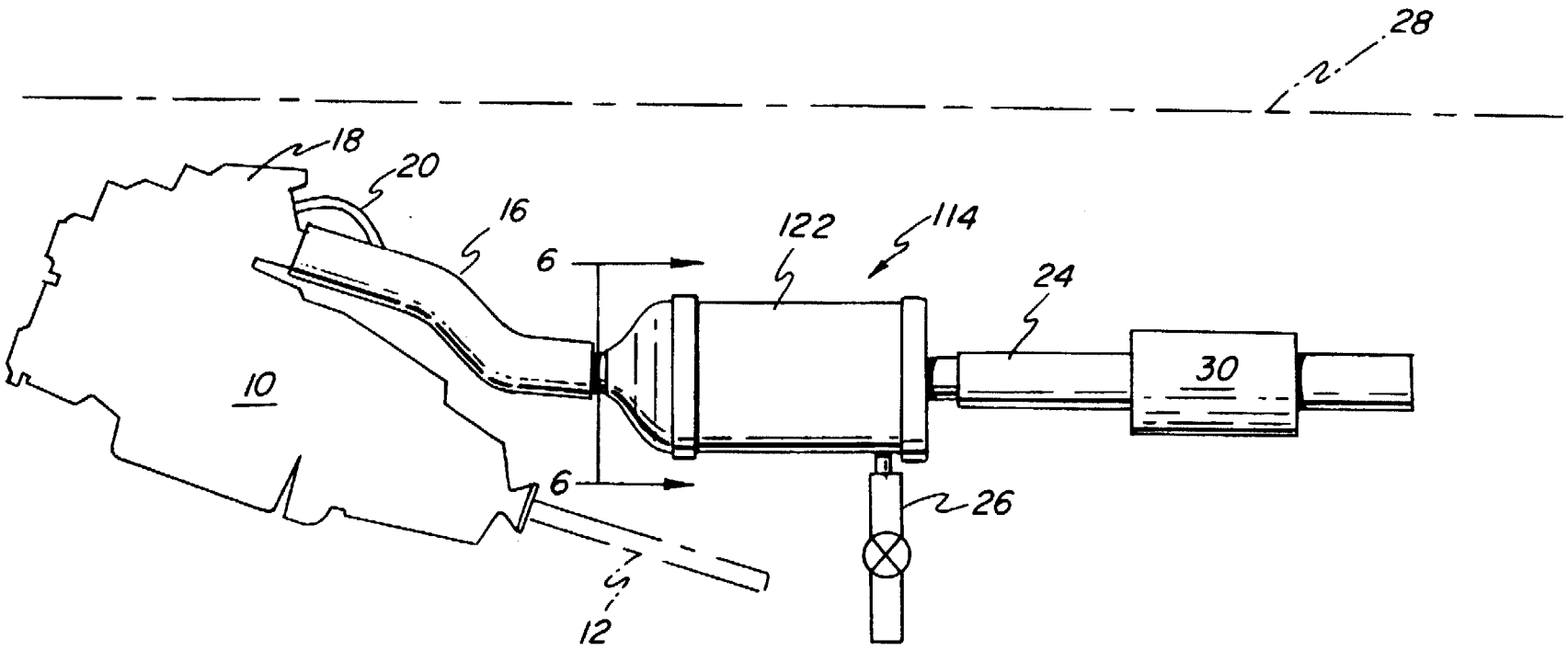
FIG. 2 is a schematic view of a marine wet exhaust system incorporating an alternative embodiment of the combined marine wet muffler and water separator of the invention.

Referring initially to FIGS. 1 and 2 of the drawings, an engine 10 for rotating a drive shaft 12 (shown in phantom) is provided with a marine wet exhaust system 14 (FIG. 1), 114 (FIG. 2) for treating and expelling exhaust gas generated by the engine 10. The marine wet exhaust system 14 (FIG. 1), 114 (FIG. 2) includes a first exhaust conduit 16 for receiving exhaust gas from an engine exhaust manifold 18; a water injection tube 20 for injecting waste coolant water from the engine 10 into the first exhaust conduit 16 to cool the exhaust gas; a muffler/water separator 22 (FIG. 1), 122 (FIG. 2) for attenuating exhaust noise and separating the waste coolant water from the exhaust flow; a second exhaust conduit 24 for expelling the exhaust gas; and a water drain 26 for releasing the waste coolant water. Since the combined wet marine exhaust muffler and water separator 22 (FIG. 1), 122 (FIG. 2) efficiently separates the waste coolant water from the exhaust gas, the path of the second exhaust conduit 24 is not critical and may discharge the exhaust either above the water line 28 (FIG. 1) or below (FIG. 2).

This contrasts with many of the prior art arrangements wherein a downward slope or grade had to be utilized to ensure drainage of water through this line. Preferably, the water drain 26 discharges the waste coolant water below the water line. While the water separator also attenuates the exhaust noise, a secondary muffler 30 may be positioned across the second exhaust conduit 24 to provide additional attenuation. Mufflers that may be used include any one of those that are commercially available. Exemplary mufflers are disclosed in U.S. Pat. Nos. 5,196,655 or 4,713,029—hereby incorporated by reference herein.

Figure 3:
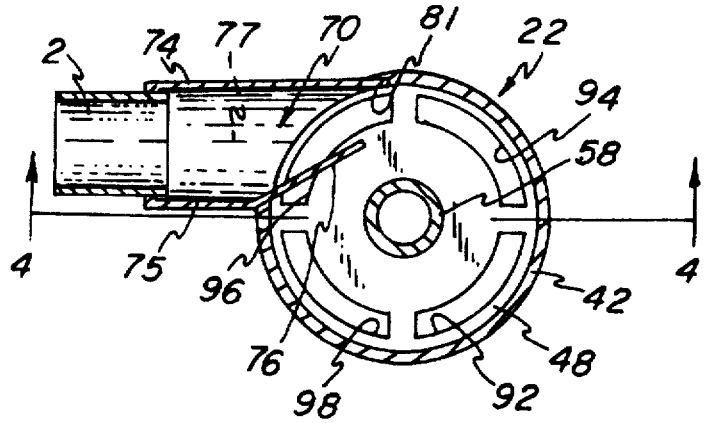
FIG. 3 is a top sectional view of the combined marine wet muffler and water separator of the marine wet exhaust system of FIG. 1, taken along the line 3—3 in FIG. 1.
Figure 4:
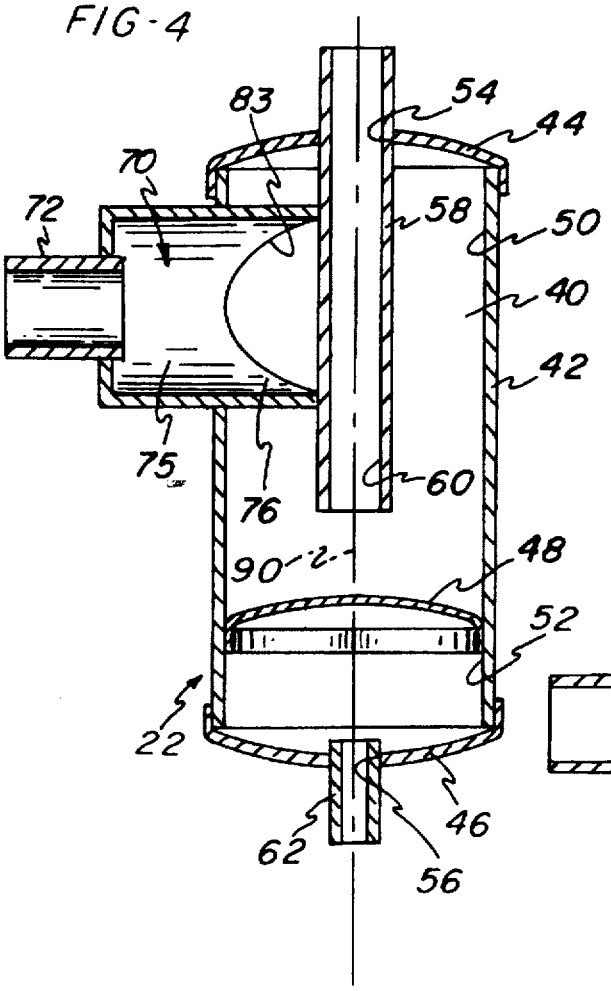
FIG. 4 is a side sectional view of the combined marine wet muffler and water separator of the marine wet exhaust system of FIG. 1, taken along the line 4—4 in FIG. 3.

As best shown in FIGS. 3 and 4, one form of the water separator 22 includes a generally cylindrical housing 40 made up from a cylindrical wall 42 and a pair of end caps 44,46 (FIG. 4) attached to the cylindrical wall 42. A transverse or calming baffle 48 is attached across the interior of the housing 40 so as to divide the housing interior into a first chamber 50 (FIG. 4) adjacent the end cap 44 and a second chamber 52 (FIG. 4) adjacent the end cap 46. The end cap 44 defines a first outlet 54 (FIG. 4) leading from the first chamber 50 while the end cap 46 defines a second outlet 56 (FIG. 4) leading from the second chamber 52. A first pipe 58 is secured through the first outlet 54 so that the first pipe 58 opens through a mouth 60 (FIG. 4) into the first chamber 50. A second pipe 62 (FIG. 4) is secured adjacent the second outlet 56.

Tangential inlet 70 (FIG. 4) is provided in communication with inlet pipe 72. Inlet 70 comprises outer wall 74 and inner wall member 75 parallel to wall 74 along opposite sides of the longitudinal axis 77 of the inlet 70 (FIG. 3). A baffle 76 is angularly disposed with respect to wall 75, extending toward wall member 74 to define a restricted opening 81 tangentially disposed along the inner circumference of cylindrical wall 42. The angular disposition of the baffle 76 relative to the wall 74 and the restricted opening 81 help to increase the velocity of the water/gas mixture as it enters the separator 22 to facilitate a swirling pattern to this mixture for purposes of effecting centrifugal separation of the water/gas mixture.

As shown in FIG. 4, the baffle 76 has a vertically disposed trailing edge 83 located at the restricted opening 81, which edge may be described as an inwardly curving, parabolic shape. The shaping of this edge 83 at the opening 81 also has been found helpful in imparting the desired swirling pattern to the fluid mixture admitted through inlet pipe 72.

Outer wall 74 and inner wall 75 of inlet 70 are spaced in parallel relation to each other and define a channel therebetween. Angled baffle 76 is contiguous with inner wall 75 and has a trailing edge 83 which extends toward the outer wall 74. A channel is defined between the parallel walls 74 and 75. Due to the angular inclination of wall 76 toward wall 74, restricted opening 81 is formed. The area at restricted opening 81 is nearly equal to or less than that in the channel to thereby facilitate velocity increase of the fluid entering housing 40 through the tangential inlet 70.

Turning again to FIG. 4, in use, exhaust gas and entrained water droplets enter the housing through the tangential inlet 70 and spiral downward about the longitudinal axis 90 (FIG. 4) of the housing toward the calming baffle 48. As the exhaust flow spirals, the relatively heavy water droplets spiral away from the axis 90 toward the cylindrical wall 42. The exhaust gas enters the mouth 60 of the first pipe 58 near the axis 90 and flows out of the housing 40 through the first outlet 54. Meanwhile, the water moves downwardly through apertures 92, 94, 96, 98 (FIG. 3) that are provided in the transverse or calming baffle 48. The number and arrangement of the apertures may, of course, be varied provided that adequate area is provided for communication of the first chamber with the second chamber 52. Separated water exits the housing 40 through the second pipe 62 disposed in the second chamber. Preferably, the water pools over the second outlet 56 to prevent exhaust gas from entering the second pipe 62.

Figure 5:
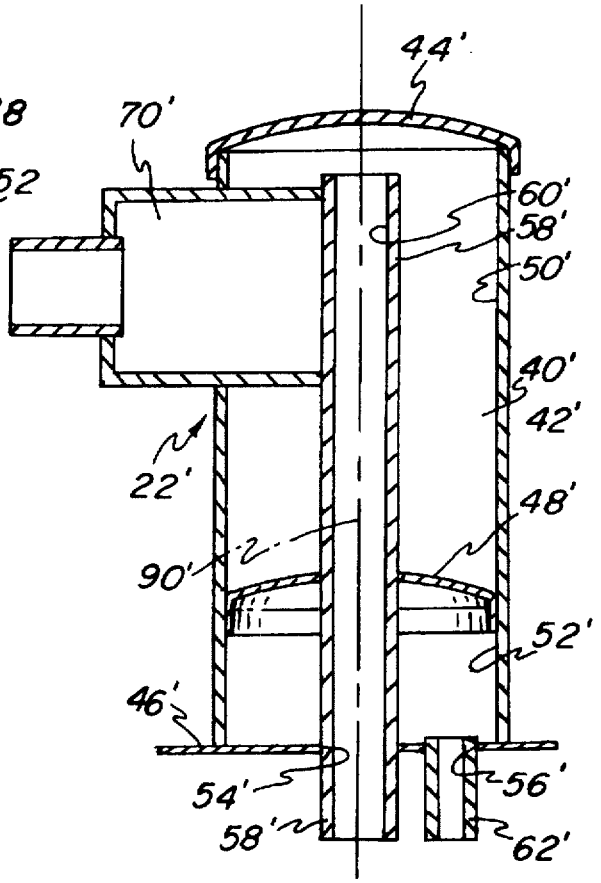
FIG. 5 is a side sectional view of an alternative embodiment of the combined marine wet muffler and water separator of the invention.

A second embodiment of the water separator 22' is shown in FIG. 5. Here, water separator 22' includes a housing 40' made up from a cylindrical wall 42', an end cap 44' and a bottom flange 46'. As with the embodiment 22 of FIGS. 3 and 4, transverse or calming baffle 48' is attached across the interior of the housing 40' so as to divide the interior into a first chamber 50' adjacent the cap 44' and a second chamber 52' adjacent the flange 46'. Unlike the embodiment shown in FIGS. 3 and 4, the flange 46' of the separator 22' includes first and second outlets 54', 56' leading from the second chamber 52'. A first pipe 58' is attached through the first outlet 54' so that the first pipe 58' passes through the transverse baffle 48' and opens through a mouth 60' into the first chamber 50'. A second pipe 62' is attached adjacent the second outlet 56' radially outwardly from the first pipe 58' and the first outlet 54'.

The housing 40' of the FIG. 5 embodiment has a tangential inlet 70' similar in structure to the tangential inlet 70 of the embodiment of FIGS. 3 and 4. In use, exhaust gas and entrained water droplets enter the housing through the tangential inlet 70' and rotate about the longitudinal axis 90' of the housing toward the calming baffle 48'. As the exhaust flow rotates, the relatively heavy water droplets spiral away from the axis 90' (FIG. 5) toward the cylindrical wall 42'. The exhaust gas enters the mouth 60' of the first pipe 58' near the axis 90' and below cap 44' and flows downwardly out of the housing 40' through the first outlet 54'. Meanwhile, the water moves downwardly through apertures (not shown) in the transverse baffle 48' into the second chamber 52', from which the water exits the housing 40' through the second pipe 62'.

Figure 6:
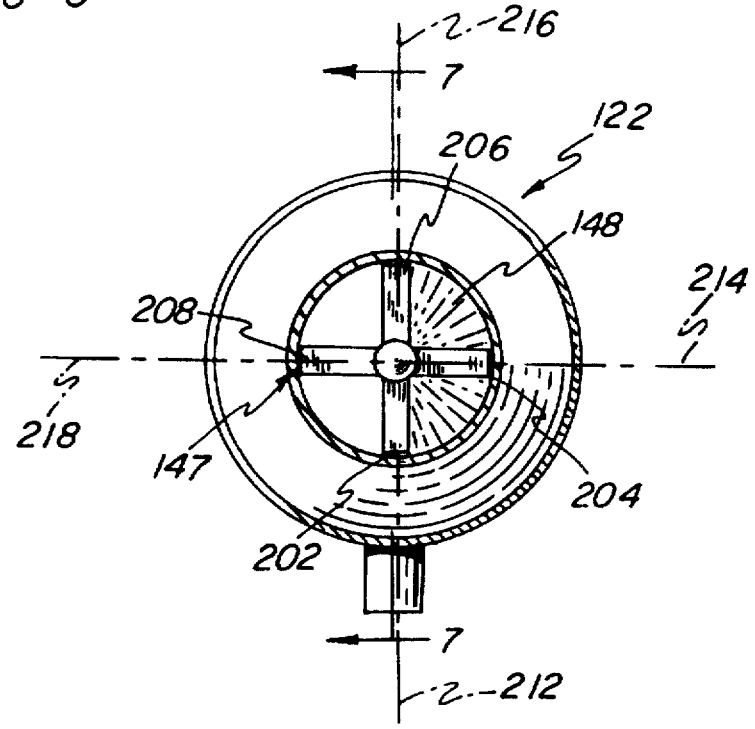
FIG. 6 is a side sectional view of a further embodiment of the combined wet muffler and water separator of the marine wet exhaust system of FIG. 2, taken along the line 6—6 in FIG. 2.
Figure 7:
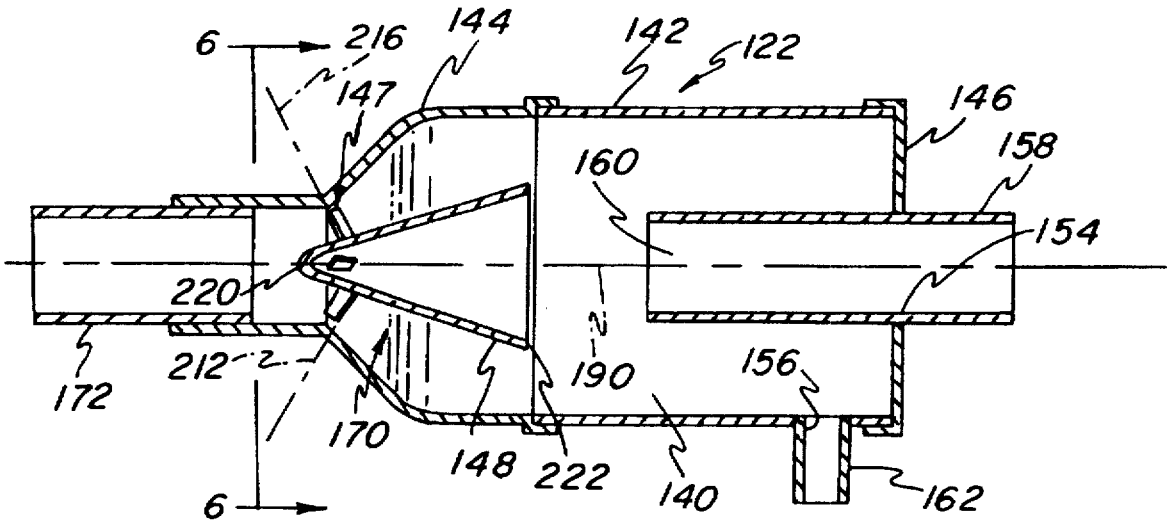
FIG. 7 is a top sectional view of the marine wet muffler and water separator of FIG. 6, taken along line 7—7 in FIG. 6.

A third embodiment of the water separator 122 is shown in FIGS. 6 and 7 wherein the water separator 122 may be placed horizontally in the marine wet exhaust system 114 as illustrated in FIG. 2. The water separator 122 comprises a housing 140 including a cylindrical wall 142 and a pair of end caps 144, 146 (FIG. 7) attached to the cylindrical wall 142. An inlet 170 (FIG. 7) is provided in communication with an inlet pipe 172 and is concentric with the longitudinal axis 190 of the housing 140. Inlet 170 includes the end cap 144, a vane structure 147, and a calming shield 148.

The end cap 144 is substantially formed of a truncated cone having an inner diameter increasing from a small diameter adjacent the inlet pipe 172 to a larger diameter as it progresses into the housing 140. The end cap 146 includes a first outlet 154 leading from within the housing 140. A first pipe 158 is attached through the first outlet 154 coaxial to the longitudinal housing axis 190 and opens through a mouth 160 into the housing 140. A second outlet 156 leading from within the housing 140 is located in the cylindrical wall 142 adjacent the end cap 146, preferably at the lowest point of the housing 140. A second pipe 162 is vertically disposed and attached to the cylindrical wall 142 adjacent the second outlet 156 below the first pipe 158 and the first outlet 154.

The vane structure 147 is attached to the end cap 144 and preferably includes a series of blades 202, 204, 206, 208 oriented radially outwardly from the longitudinal housing axis 190. Each blade has a center axis 212, 214, 216, 218 at an angle of inclination from the longitudinal housing axis 190 wherein each blade is nearly perpendicular to the longitudinal housing axis 190 (FIG. 7). Furthermore, each blade is preferably rotated about its center axis for redirecting the water/gas mixture as it enters the separator 122 to facilitate a swirling pattern and to effect centrifugal separation of the water/gas mixture. The number and arrangement of the blades may, of course, be varied provided that adequate swirling motion is imparted to the water/gas mixture as it enters the housing 140. Alternatively, the blades may be provided with a curved surface for assisting in producing the swirling pattern in the fluid mixture admitted through inlet pipe 172. The calming shield 148 is substantially conical having first and second ends 220, 222 and is coaxially disposed relative to the longitudinal housing axis 190. The cross sectional diameter of the calming shield 148 increases from the first end 220 to the second end 222. The first end 220 is attached to the vane structure 147 while the second end 222 is located proximate the mouth 160.

In operation, a mixture of exhaust gas and entrained water droplets enter the housing through the inlet 170 wherein the vane structure 147 imparts a swirling motion to the mixture. The calming shield 148 restricts passage of the exhaust mixture containing water droplets into the first pipe 158 through the mouth 160. As the exhaust mixture spirals, the relatively heavy water droplets spiral away from the axis 190 toward the cylindrical wall 142. The extracted water moves downwardly to the bottom of the housing 140 by gravitational force and then out of the separator 122 through the second pipe 162. Meanwhile, the dried exhaust gas enters the mouth 160 of the first pipe 158 near the axis 190 and flows out of the housing 140 through the first outlet 154.

Having described the invention in detail and by reference to preferred embodiments thereof, it will be apparent that modifications and variations are possible without departing from the scope of the appended claims.

What is claimed is:

1. Apparatus for muffling noise in and separating a marine exhaust fluid flow comprising exhaust gas and cooling liquid, said apparatus comprising a housing having a longitudinally extending axis, an inlet means communicating with said housing for providing ingress of said fluid flow, said inlet means including a port member and an inlet baffle proximate said port member, said inlet means further including first and second wall members disposed in spaced relationship and defining a channel therebetween, said inlet baffle being contiguous to said second wall and extending toward said first wall at said port member, said inlet baffle and said first wall, at said port member, defining a restricted opening having a smaller area than said channel, said inlet baffle further including a trailing edge portion adjacent said port member and having a concave shape, said inlet means inducing said fluid flow to swirl about said axis to impart centrifugal force thereon, a first outlet means communicating with said housing for providing egress of said exhaust gas and a second outlet means communicating with said housing for providing egress of said cooling liquid.

2. Apparatus as recited in claim 1 wherein said inlet baffle further includes a substantially parabolic concave trailing edge portion adjacent said port member.

* * * * *